US008002426B2

(12) United States Patent
Pearson et al.

(10) Patent No.: US 8,002,426 B2
(45) Date of Patent: Aug. 23, 2011

(54) RAIL LIGHT

(75) Inventors: Dennis Pearson, Foothill Ranch, CA (US); Terry Horwitz, Garden Grove, CA (US); Richard Horvath, Mission Viejo, CA (US)

(73) Assignee: Tempo Industries, Inc., Irvine, CA (US)

( * ) Notice: Subject to any disclaimer, the term of this patent is extended or adjusted under 35 U.S.C. 154(b) by 172 days.

(21) Appl. No.: 12/344,089

(22) Filed: Dec. 24, 2008

(65) Prior Publication Data

US 2010/0091494 A1 Apr. 15, 2010

Related U.S. Application Data

(60) Provisional application No. 61/104,604, filed on Oct. 10, 2008.

(51) Int. Cl.
*F21S 8/00* (2006.01)
*F21S 4/00* (2006.01)
*F21V 21/00* (2006.01)

(52) U.S. Cl. ..... 362/152; 362/217.01; 362/217.1; 362/249.03; 362/146

(58) Field of Classification Search ..... 362/399, 362/400, 430, 145, 146, 151, 152, 576, 217.01, 362/217.1, 223, 249.02, 581, 156, 217.12, 362/362, 368, 370, 371, 249.03, 249.07, 362/249.11, 418, 432; 256/67, 65.16
See application file for complete search history.

(56) References Cited

U.S. PATENT DOCUMENTS

| | | | | |
|---|---|---|---|---|
| 3,648,982 | A * | 3/1972 | Sabel et al. | 256/65.05 |
| 3,756,567 | A * | 9/1973 | Murdock | 256/21 |
| 4,161,769 | A * | 7/1979 | Elliott | 362/146 |
| 4,597,033 | A * | 6/1986 | Meggs et al. | 362/183 |
| 4,943,900 | A * | 7/1990 | Gartner | 362/227 |
| 5,343,375 | A * | 8/1994 | Gross et al. | 362/248 |
| 5,791,762 | A * | 8/1998 | Wroblewski | 362/152 |
| 6,213,622 | B1 | 4/2001 | Shimada | |
| 6,305,109 | B1 * | 10/2001 | Lee | 40/546 |
| 6,452,317 | B1 * | 9/2002 | Tseng | 313/318.01 |
| 6,554,446 | B1 | 4/2003 | Walsh | |
| 6,595,671 | B2 | 7/2003 | Lefebvre et al. | |
| 6,726,348 | B2 * | 4/2004 | Gloisten | 362/372 |
| 7,448,768 | B2 * | 11/2008 | Sloan et al. | 362/145 |
| 7,648,251 | B2 * | 1/2010 | Whitehouse et al. | 362/223 |

(Continued)

FOREIGN PATENT DOCUMENTS

EP 0669492 A1 8/1995

OTHER PUBLICATIONS

Tempo Industries, Sentinel System, "Wall Mounted LED Stair Lighting System", 2 Pages. (2002).

(Continued)

*Primary Examiner* — David Crowe
(74) *Attorney, Agent, or Firm* — Greenberg Traurig LLP; Franklin D. Ubell

(57) ABSTRACT

A stair rail light attachable between first and second vertical stair rail posts and having an elongated central housing whose interior mounts an extrusion designed to hold and position a plurality of LED carrier members wherein the housing slidably engages respective mounting plugs pivotally attached to respective stair rail posts, thereby permitting the length of the rail light to be adjusted in the field.

33 Claims, 10 Drawing Sheets

U.S. PATENT DOCUMENTS

| | | | | |
|---|---|---|---|---|
| 2005/0265019 | A1* | 12/2005 | Sommers et al. | 362/217 |
| 2005/0270774 | A1* | 12/2005 | Pan | 362/217 |
| 2007/0047229 | A1 | 3/2007 | Lee | |
| 2008/0002399 | A1 | 1/2008 | Villard et al. | |
| 2008/0030981 | A1 | 2/2008 | Mrakovich et al. | |
| 2008/0106892 | A1 | 5/2008 | Griffiths et al. | |
| 2008/0304253 | A1* | 12/2008 | Handsaker | 362/146 |

OTHER PUBLICATIONS

Tempo Industries, Sentinel System, "Rail & Seat Mounted LED Stair Lighting Products". 1 Page. (2002).

Tempo Industries, Sentinel System, "2100GS—Single Step—Grey Stripe Left or Right End Cap", 2 Pages. (2002).

Tempo Industries, Guardian (Orange Sidebar), "Tread/Riser Stair Nose Lighting", 3 Pages. (2005).

Tempo Industries, Guardian (Orange Sidebar), "Step Edge Lighting", 2 Pages. (2005).

Tempo Industries, Sentinel (Yellow Sidebar), "Sentinel Striped Step Nose", 2 Pages. (2005).

Temp Industries, Internal Drawing, Never Published, (Drawing of rail light installed at 10 Deg.), 1 Page. (2002).

Tempo Industries, Sentinel with biinary technology, Product Brochure, Wall Light, Rail Light, Striped Step Nose, 8 Pages. (2007).

Tempo Industries, Inc.; International Search Report in connection with PCT/US2009/054746; Korean International Searching Authority; Apr. 2009; 4 pages.

* cited by examiner

RAIL LIGHT

RELATED APPLICATIONS

This application claims the Paris Convention priority of U.S. Provisional Application No. 61/104,604 entitled "Rail Light," filed Oct. 10, 2008, the contents of which are hereby incorporated by reference in its entirety.

BACKGROUND

1. Field

The subject disclosure relates to the field of electrical lighting apparatus and light fixtures, and more particularly to a field installable stair rail light.

2. Related Art

Various lighting systems have been devised for theaters and other venues for lighting aisles, stairs and the like. Low voltage lighting systems have been used which incorporate LED light strips in the case of steps and stairs. Such strips have been provided at the edge or "nose" of each stair such that the edge of each step is illuminated and visible to someone walking up or down the stairway.

SUMMARY

The following is a summary of various aspects and advantages realizable according to various embodiments of the invention. It is provided as an introduction to assist those skilled in the art to more rapidly assimilate the detailed discussion which ensues and does not and is not intended in any way to limit the scope of the claims which are appended hereto in order to particularly point out the invention.

According to an illustrative embodiment, a stair rail light is provided which may be attached between first and second vertical stair rail posts to direct illumination from either side of the light fixture onto the surrounding aisle-way beneath the light. The rail light of the illustrative embodiment comprises an elongated central housing whose interior mounts an extrusion designed to hold and position a plurality of LED carrier members. Each end of the housing slidably engages an end plug component, which is pivotally attached to the stair rail. The slidable engagement between the housing and respective end plugs permits the length of the rail light to be adjusted in the field.

In one embodiment, the housing has a plurality of axially-running projections on an inside surface thereof and respective inwardly projecting lips along respective lower edges. Each end plug in turn has an outer surface which includes a plurality of axially-running grooves each positioned to slidably receive and mate with a respective one of the axially-running interior projections of the housing and recesses formed respectively along first and second lower edges thereof, which are sized and dimensioned to slidably receive and mate with a respective one of the inwardly projecting lips on the lower edges of the housing.

In such an embodiment, the slidable mating of the axially-running grooves with the axially-running projections and the slidable engagement of the first and second lower edges with the first and second recesses provides the adjustability which permits the length of the light fixture to be adjusted in the field to adapt to varying dimensional requirements; i.e. varying distances between opposing vertical stair rail portions to which the light is attached.

In one embodiment, the extrusion may be so shaped and dimensioned that it snap-fits into the housing, and may include a plurality of interior projections disposed to position and retain the LED carrier members. In one embodiment, the plurality of interior projections comprise a centrally positioned depending projection and first and second depending projections positioned on either side of said centrally depending projection, each of the first and second depending projections having an end shaped to retain an edge of one of the LED carrier members. In such an embodiment, each said LED carrier member may comprise a flat LED mounting surface and a channel of Y-shaped cross-section wherein the channel engages the end of the depending central projection of the extrusion.

In one illustrative embodiment, the light fixture apparatus may further comprise first and second pivot plates for pivotally attaching a respective one of said end plugs to a stair rail post, each pivot plate including a front surface having a plurality of mounting holes, a circular opening for passing an electrical cable, and first and second tabs projecting therefrom for receiving a pivot pin for pivotally attaches an end plug to its respective pivot plate. Each pivot plate may further comprise an inner adapter plate positioned behind its front surface to strengthen the structure.

DRAWINGS

The features of the present disclosure will become more apparent with reference to the following description taken in conjunction with the accompanying drawings wherein like reference numerals denote like elements and in which.

DETAILED DESCRIPTION

Figure 1:
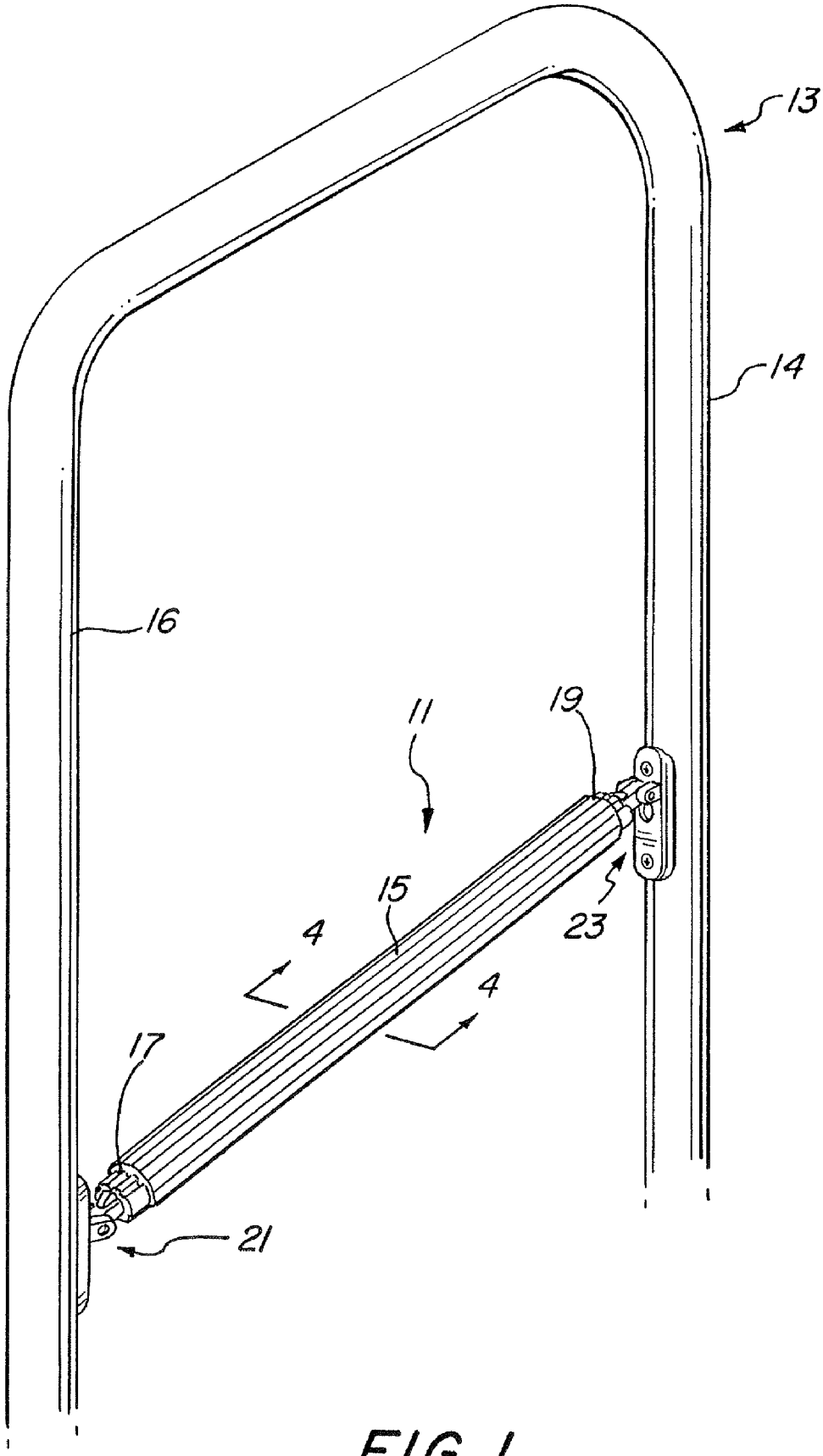
FIG. 1 is front perspective view of an illustrative rail light embodiment mounted on a stair rail.

FIG. 1 shows a rail light 11 according to an illustrative embodiment mounted between vertical pole portion 14, 16 of a free standing stair rail 13. Such a free standing stair rail 13 may be installed, for example, in the middle of descending aisle way.

The rail light 11 of the illustrative embodiment includes an elongated outer housing 15, which attaches at its respective ends 17, 19 to respective mounting brackets 21, 23. The housing 15 and mounting brackets 21,23 are preferably fabricated of die cast aluminum for strength but could be fabricated of plastic, other metals or composites in various embodiments.

Figure 2:
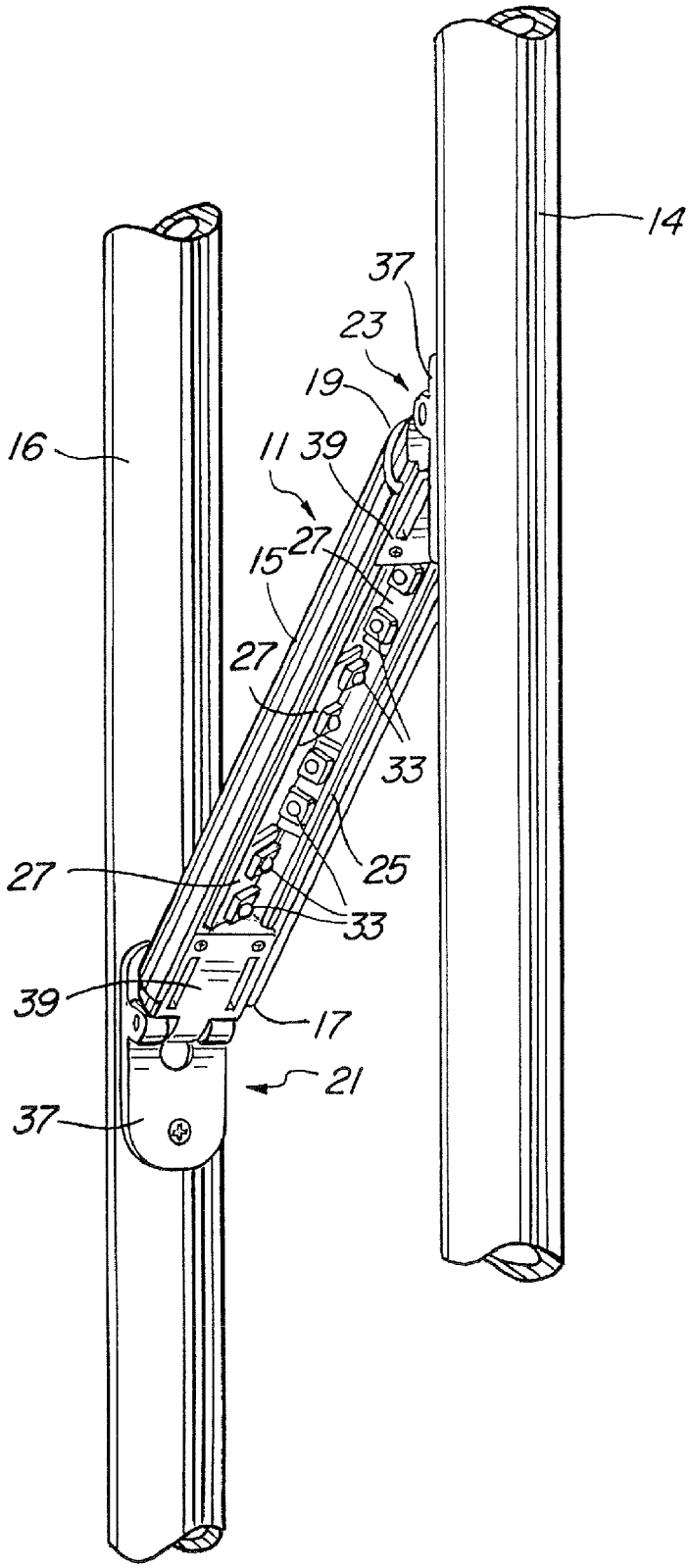
FIG. 2 is a perspective view of the underside of the rail light of FIG. 1.

As may be seen in FIG. 2, the housing 15 has an inner extrusion 25 mounted therein which is designed to pop into and be retained by the housing 15, as will be discussed in further detail below. The inner extrusion 25 in turn snug-fittingly receives a number of lampholder units or carriers, e.g. 27, which in the illustrative embodiment comprise a number of LED lamps 33 and associated components. One set of LED carriers 27 is angled to direct light to the left of the stair light 11, while a second set is angled to direct light to the right of the light 11.

Figure 3:
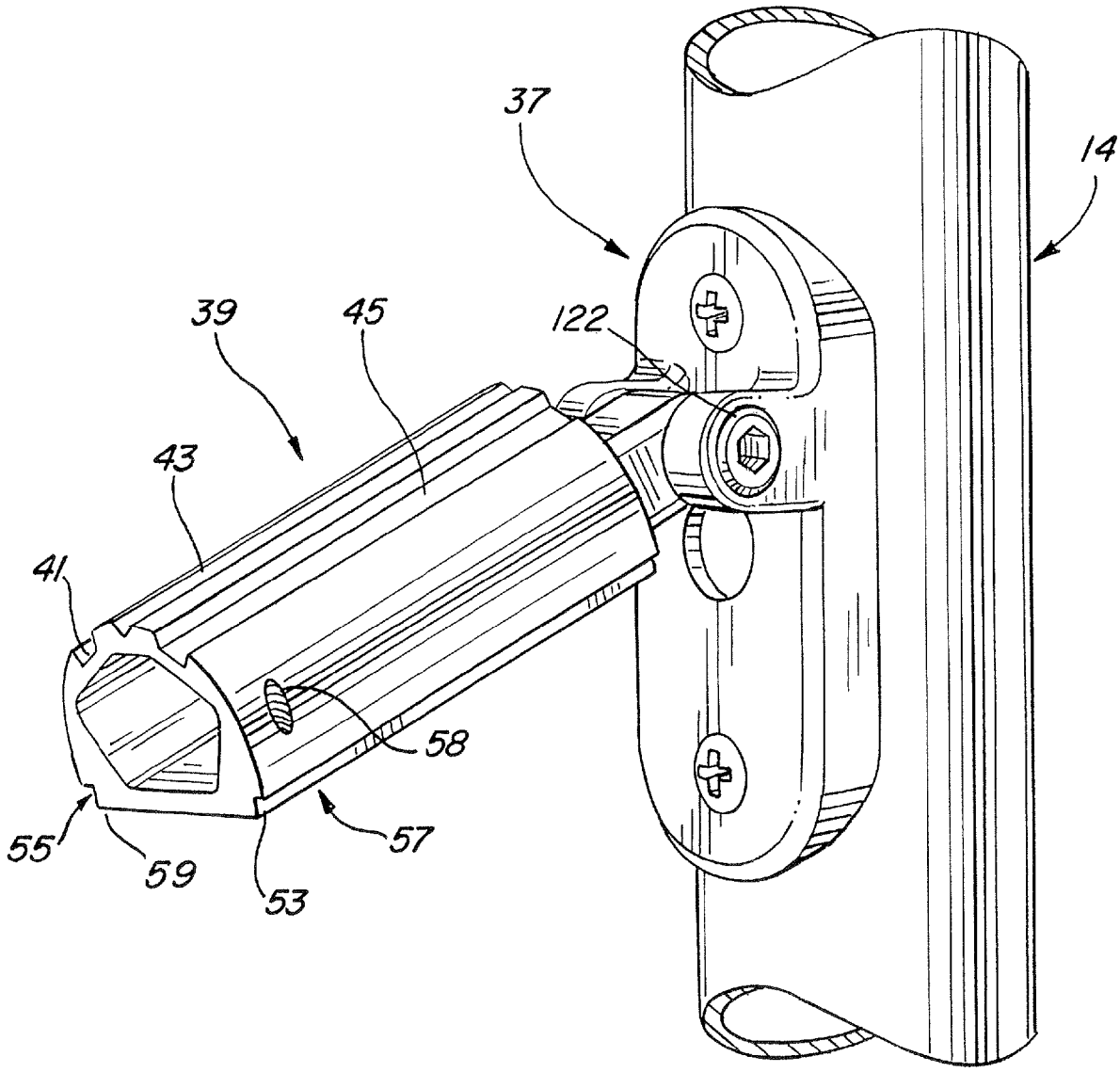
FIG. 3 is a perspective view illustrating an end plug and pivot plate according to an illustrative embodiment.
Figure 4:
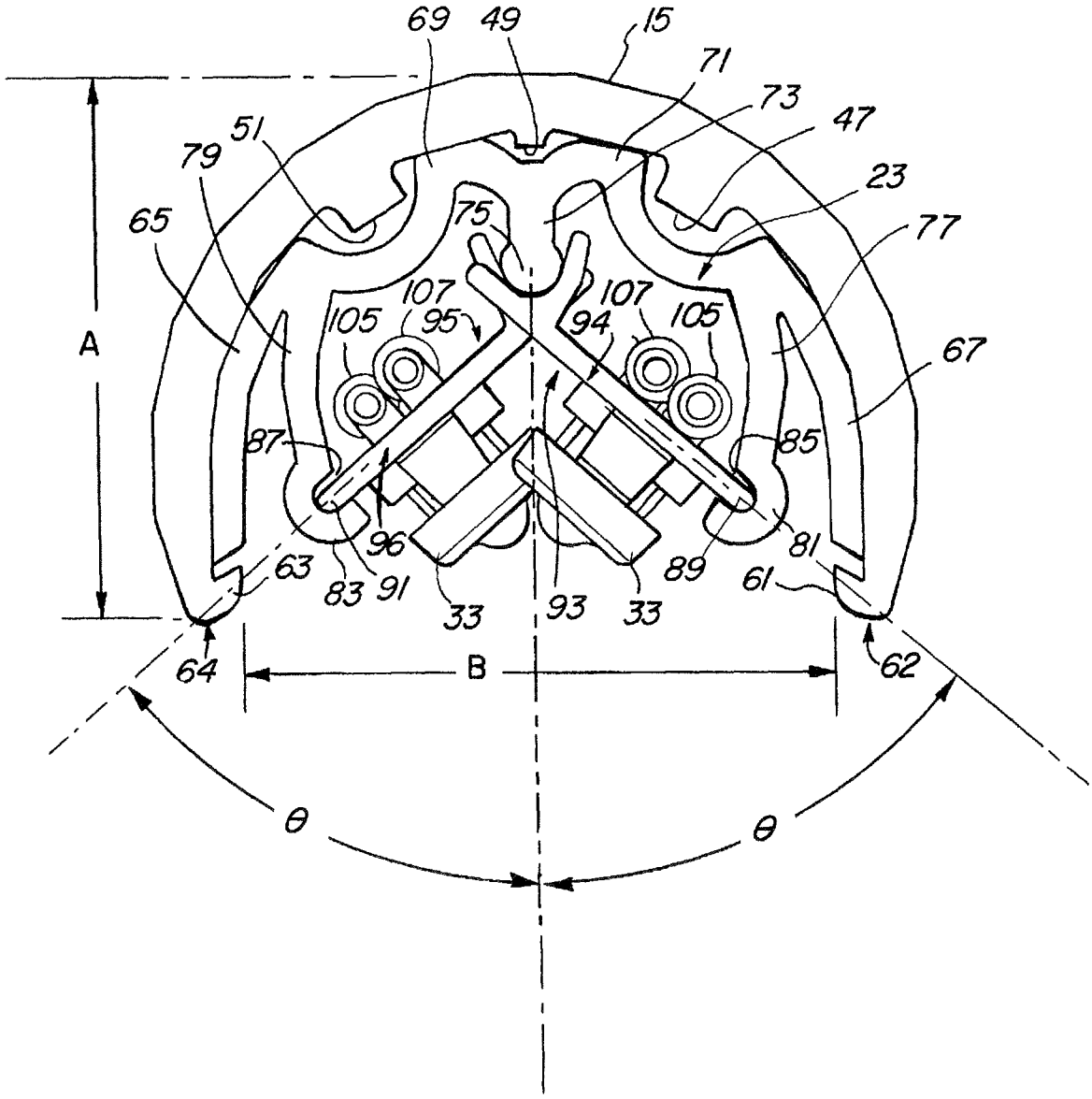
FIG. 4 is a cross-sectional view of the rail light embodiment taken at 4-4 of FIG. 1.

As illustrated in FIG. 3, each mounting bracket 21, 23 of the illustrative embodiment includes a pivot plate 37 attached to one of the stair rails 5, e.g. 14. A rail support end plug 39 is pivotally attached to the pivot plate 37. The end plug 39 has three parallel, axially-running grooves 41, 43, 45 on its outer upper surface, which slidably receive mating projections 47, 49, 51 formed on the interior 53 of the housing 15 (FIG. 4). In the illustrative embodiment, these projections 47, 49, 51 run lengthwise (axially) in parallel and extend the entire length of the housing 15.

The end plug 39 further has respective recesses 53, 55 formed along each of its respective lower edges or ends 57, 59. These recesses 53, 55 are captured by respective cooperating lips 61, 63 formed on respective lower edges or ends 62, 64 of the housing 15 (FIG. 4) to thereby slidably position the housing 15 within the end plug 39.

As may be appreciated, the housing 15 telescopically slides with respect to the end plug 39, thereby providing adjustability when installing the rail light 11 to stair rail posts or other surfaces, e.g. 14, 16 in the field. Threaded screw holes 58 are formed in the end plug 39 to receive set screws or other devices for fixing the housing 15 in position once proper positioning is achieved during installation. Representative dimensions of an illustrative embodiment if the housing 15 are A=1.06 inches, B=1.10 inches.

Figure 5:
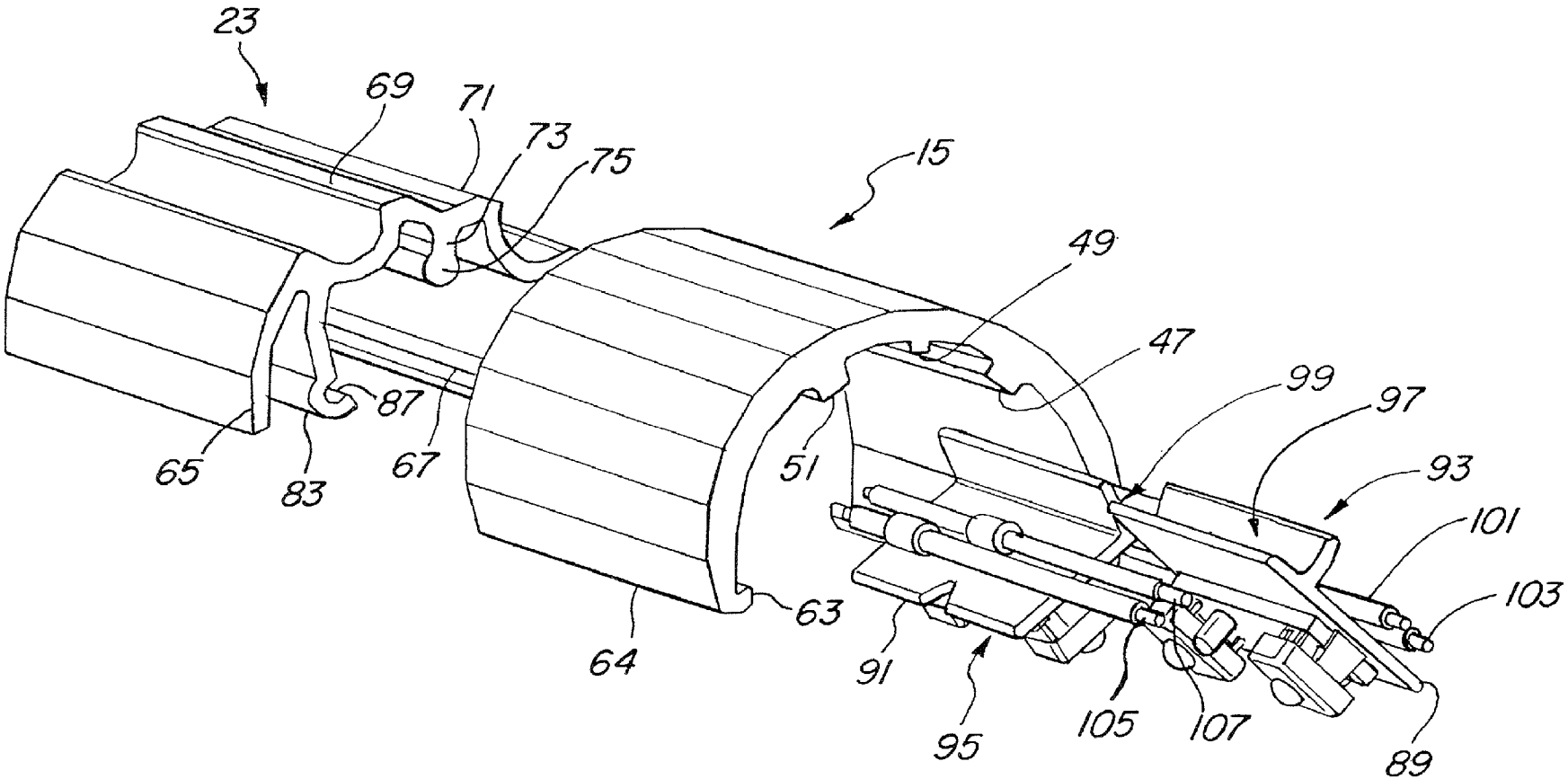
FIG. 5 is a perspective exploded fragmentary view illustrating selected components of the illustrative rail light embodiment.
Figure 6:
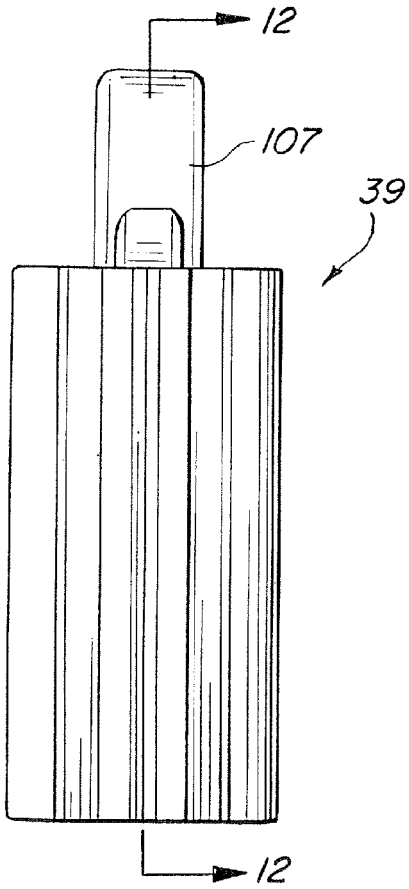
FIG. 6 is a top view of an end plug according to an illustrative embodiment.
Figure 9:
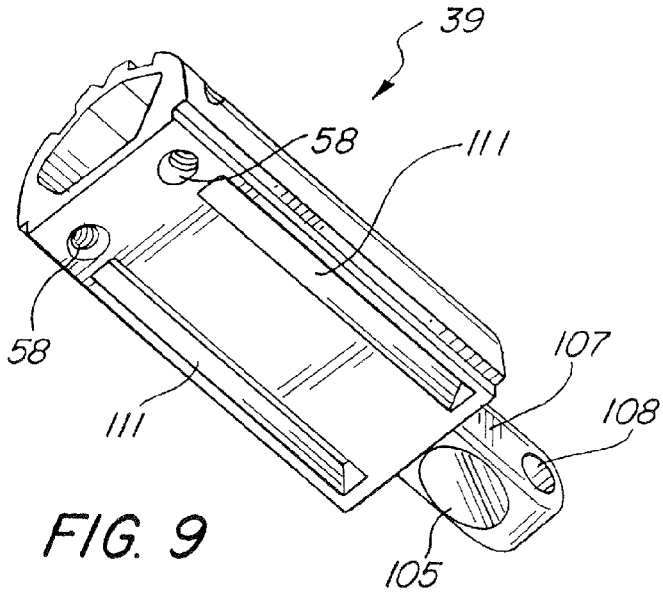
FIG. 9 is perspective view of the underside of the end plug of FIG. 6.
Figure 7:
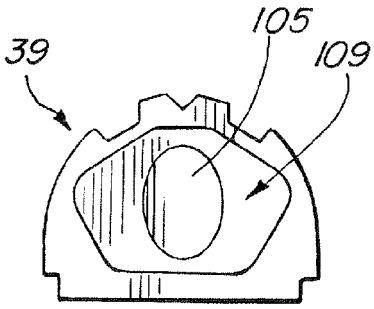
FIG. 7 is an end view of the end plug of FIG. 6.
Figure 8:
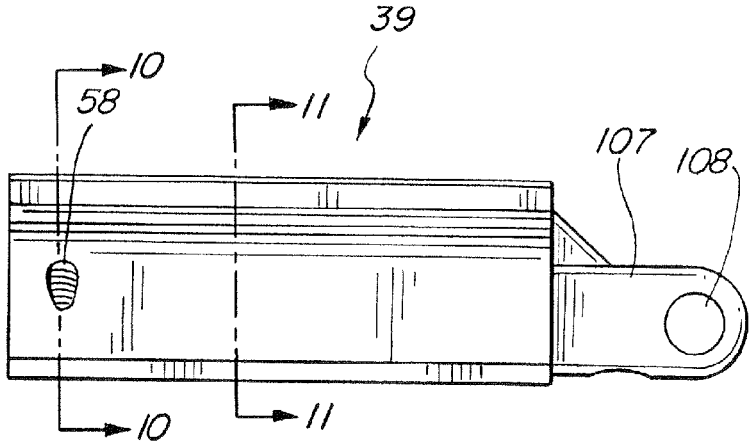
FIG. 8 is a side view of the end plug of FIG. 6.
Figure 10:
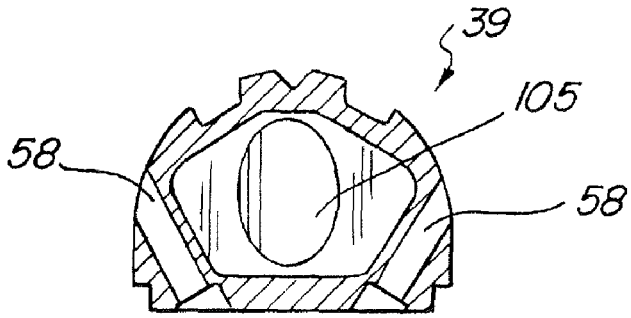
FIG. 10 is a sectional view of the end plug taken at 10-10 of FIG. 8.
Figure 11:
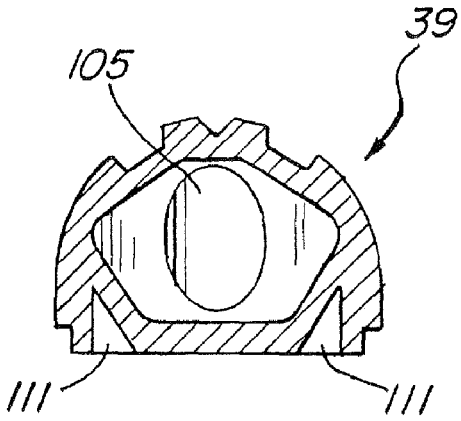
FIG. 11 is a sectional view of the end plug taken at 11-11 of FIG. 8.

The construction of the housing 15, extrusion 23 and lamp carriers 27 is further illustrated in FIGS. 4 and 5. As shown, the extrusion 23 has outer side surfaces 65, 67, and two upper surfaces 69, 71, which engage the interior surface of the housing 15. The outer side surfaces 65, 67 are flexible and of such stiffness that the extrusion 23 snap-fits vertically into the housing, preferably such that it cannot be removed by hand (i.e. without a tool.)

A central projection 73 with an end 75 of bulbous cross-section depends from the center of the inner surface of the extrusion 23. Symmetrically formed, downwardly projecting interior surfaces 77, 79 also depend from the inner surface of the extrusion 23 on either side of the central projection 73 and terminate in grooved ends 81, 83, which ends 81, 83 appear "hook-shaped" in cross-section. The inner extrusion 23 is preferably formed of a suitable plastic.

As further illustrated, the grooves 85, 87 in ends 81, 83 of the interior surfaces 77, 79, slidably receive respective edges 89, 91 of LED carriers 93, 95, each of which includes a planar rectangular portion 94, 96, terminating at one end in channels 97, 99 of "Y-shaped" cross-section. These channels 97, 99 slidably receive the bulbous end 75 of the central extrusion projection 73.

Respective electrical conductor pairs 105, 107 run through the interior of the inner extrusion 23 and are attached to the respective LED carriers, e.g. 93, 95, which may be fabricated of a suitable plastic. In the illustrative embodiment, the carriers 93, 95 are positioned with the respective planes of their LED mounting surfaces 94, 96 at an angle θ of, for example, 20 degrees to the vertical, resulting in oppositely directed LED light beams well-positioned to illuminate step surfaces on either side of the rail light 11.

Figure 12:
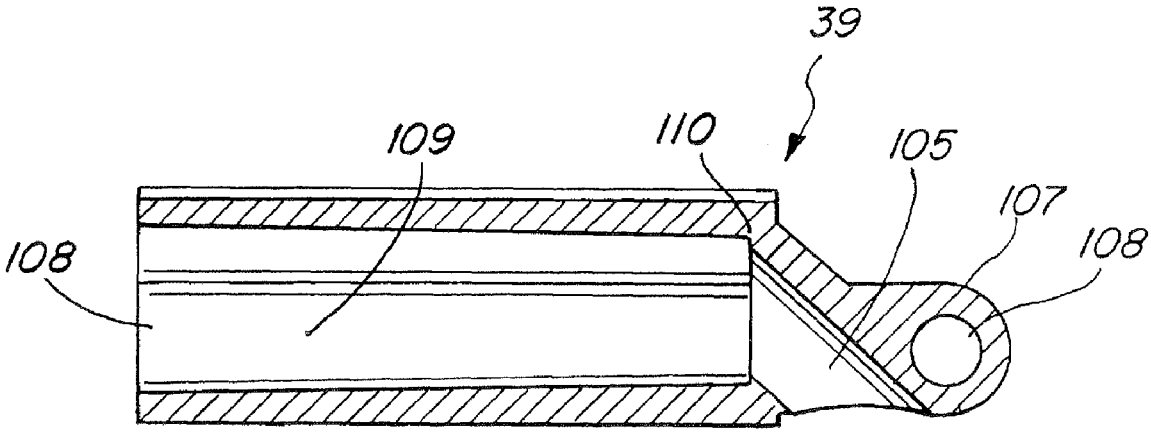
FIG. 12 is a sectional view of the end plug taken at 12-12 of FIG. 6.
Figure 15:
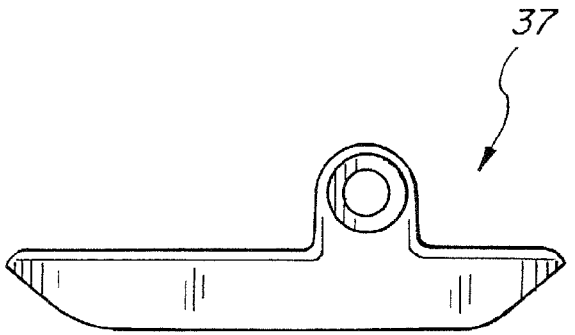
FIG. 15 is a side view of the pivot plate of FIG. 13.

FIGS. 6 to 12 illustrate the rail support end plug 39 in further detail. The plug 39 includes a rear passageway 105, which leads from the underside of attachment tab 107 into the interior 109 of the plug 39 and provides for passage of an electrical power cable. As noted above, threaded openings 58 on the underside of the end plug 39 receive suitable set screws to fix the housing 15 in position. The interior 109 of the plug 39 is tapered from a wider width at the front opening 108 to a narrower width at the rear end 110 as shown in FIG. 12 to facilitate removal from a mold. Core relief cut-outs 111 are formed on the underside of the plug 39 to reduce the amount of material required to form the part and to speed-up the molding process. A cylindrical opening 108 is formed in the tab 107 to receive a pivot pin 122 (FIG. 3).

FIGS. 13 to 19 illustrate further details of the pivot plate 37. The plate 37 has a front surface 120 which includes two mounting holes 115, as well as a circular opening 117, which passes the electrical power cable. Respective mounting tangs 119, 121 extend above the front surface 120 to receive a suitable pivot pin, bolt or other device 122 (FIG. 3) for pivotally interconnecting the plug 39 to the plate 37. The bottom surface 123 of the plate is arcuately curved in cross-section to better conform to the contour of a rail, e.g. 14, to which the plate 37 is attached.

Figure 16:
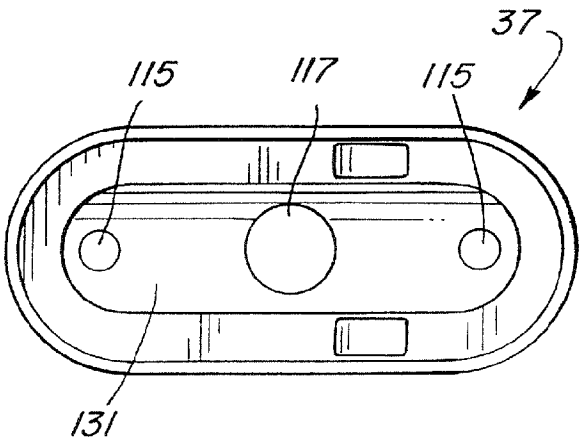
FIG. 16 is a bottom view of the pivot plate of FIG. 13.
Figure 13:
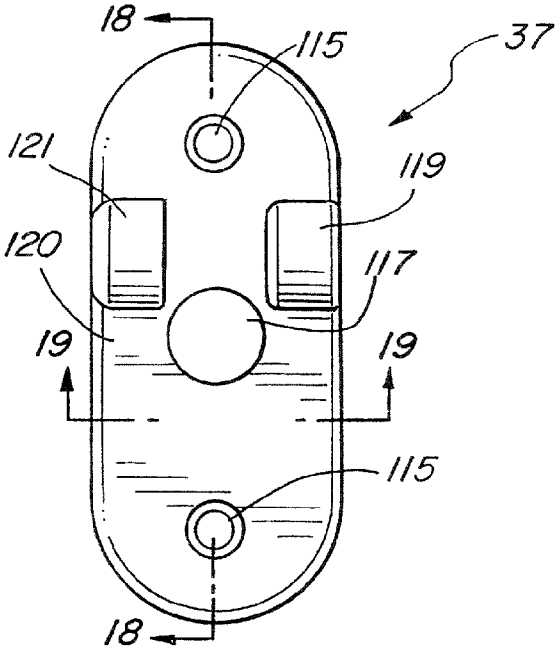
FIG. 13 is a top view of a pivot plate according to an illustrative embodiment.
Figure 14:
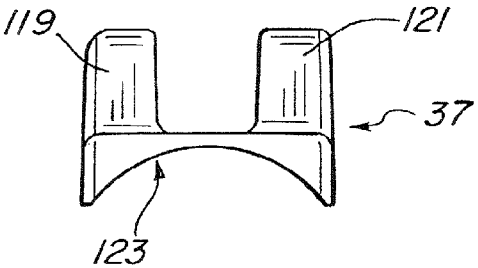
FIG. 14 is an end view of the pivot plate of FIG. 13.
Figure 17:
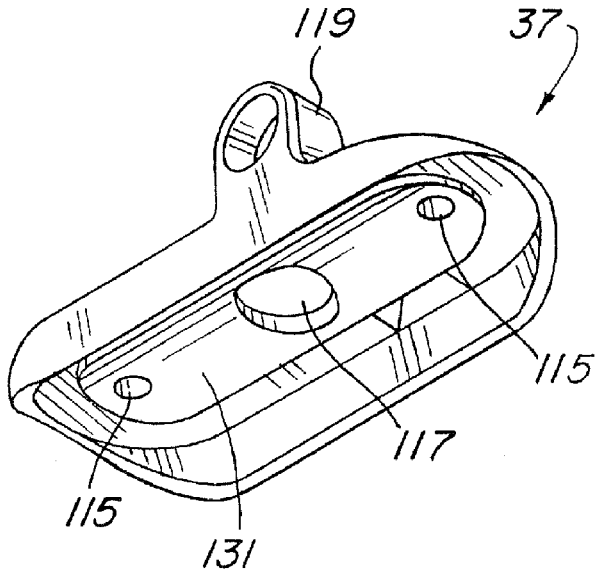
FIG. 17 is a perspective view of the underside of the pivot plate of FIG. 13.
Figure 18:
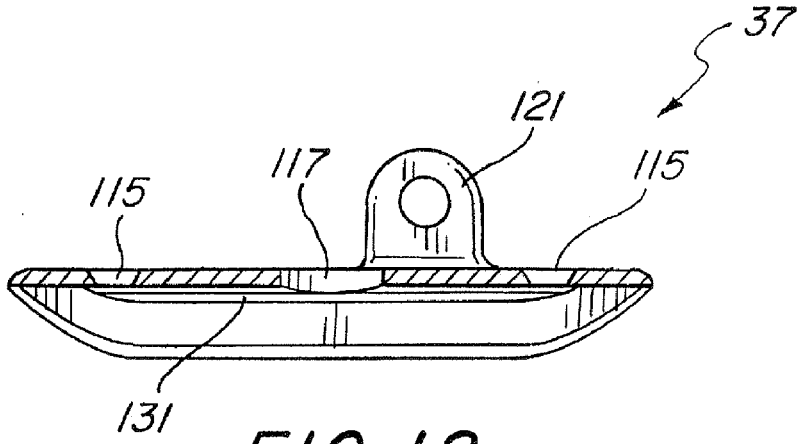
FIG. 18 is a sectional view of the pivot plate of FIG. 13 taken at 18-18 of FIG. 13.
Figure 19:
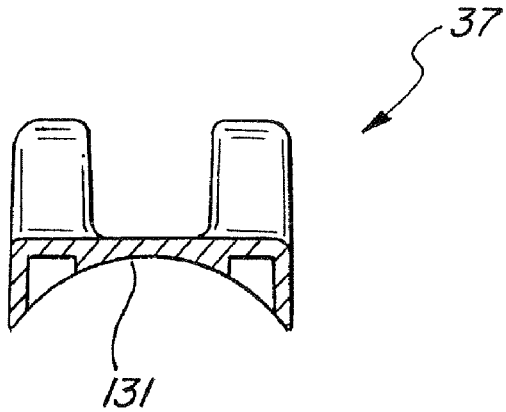
FIG. 19 is a sectional view of the pivot plate of FIG. 13 taken at 19-19 of FIG. 13.

As may be seen in FIGS. 16 and 17 an inner adapter plate 131 is positioned on the underside of the plate 37 in order to strengthen the structure and prevent damage from over-tightening of screws inserted into openings 115 to attach the pivot plate 37 to a stair rail or other surface. In the illustrative embodiment, the inner adapter plate 131 and pivot plate 37 are molded as a single, unitary part, but could be separate parts in other embodiments. In other embodiments the inner adapter plate 131 could be omitted.

In the illustrative embodiment, each carrier, e.g. 93, 95, mounts two LEDs and their associated driver circuitry, with the LEDs 33 being sized from, for example, ¼ to 1 watt. Suitable lenses may be applied to the LEDs 33 as desired. A water tight, transparent cover may be provided over the opening in the underside of the housing 15 to transmit light to a stairway while shielding the LEDs 33 from the elements. Such a cover may also comprise an optical lens. Clamping attachment of the plugs 39 to a stair rail or other surface could also be employed in place of the pivot plates 37. The plates 37 and plugs 39 may each be molded from A 380.0-F die casting aluminum alloy or other suitable materials.

Figure 20:
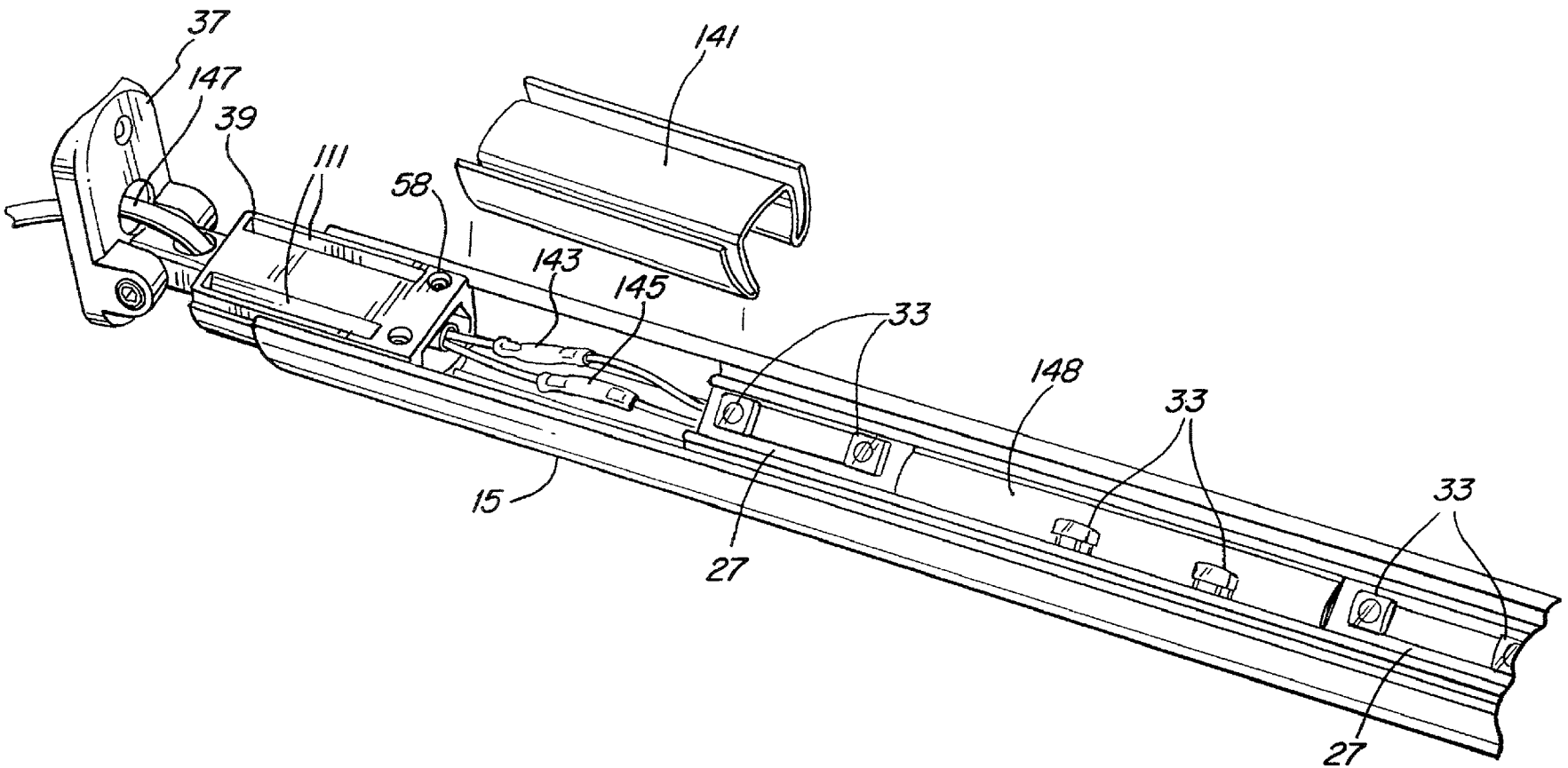
FIG. 20 is a partial perspective view of a portion of the underside of an illustrative embodiment.

FIG. 20 shows an illustrative configuration of the underside of the rail light 11. As may be seen in this view, a snap-fit plastic cover 141 is insertable into the housing to cover electrical interconnections 143, 145, which emanate from a power cable 147. The cover 141 also positions the left-most LED carrier 27 in the channel provided by the extrusion 23. A plastic spacer 148 may be shaped to have the same cross-section as the carrier members 94, 95 shown in FIG. 4 and therefore may be inserted into the extrusion 23 in the same manner as the carriers 27. The spacer 148 spaces one LED carrier 27 a selected distance apart from an adjacent LED carrier 27. Such spacers 148 are inserted as desired between adjacent carrier pairs 27 down the length of the extrusion 23, on each side thereof, in an illustrative embodiment.

Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed:

1. A light fixture comprising:

a plurality of LED carrier members each comprising an LED;

an elongated central housing having a plurality of axially-running projections on an inside surface thereof, said inside surface terminating in first and second lower edges, each first and second lower edge having a respective inwardly projecting lip;

first and second end plugs for insertion into the opposite ends of said housing, each end plug having an outer surface including a plurality of axially-running grooves each positioned to slidably receive and mate with a respective one of said axially-running projections, said outer surface further having first and second recesses formed respectively along first and second lower edges thereof, said first and second recesses each being sized and dimensioned to slidably receive and mate with a respective one of said inwardly projecting lips; and an elongated extrusion positioned within a portion of the interior of said housing, said extrusion including a plurality of outer surfaces shaped and dimensioned such that said extrusion snap-fits into said housing, said extrusion further including a plurality of interior projections disposed to position and retain each of said plurality of LED carrier members.

2. The light fixture of claim 1 wherein said plurality of interior projections comprise:

a central depending projection having an end; and first and second depending projections positioned on either side of said central depending projection, each of said first and second depending projections having an end shaped to retain an edge of one of said LED carrier members.

3. The light fixture of claim 2 wherein each of said LED carrier members comprises an LED mounting surface and a channel.

4. The light fixture of claim 3 wherein each said channel engages the end of said depending central projection.

5. The light fixture of claim 4 wherein each LED mounting surface is disposed at a selected angle to the vertical.

6. The light fixture of claim 5 wherein said angle is 20 degrees.

7. The light fixture of claim 5 wherein a first LED carrier member is positioned to direct light toward one side of said housing and a second LED carrier member is disposed to direct light toward the other side of said housing.

8. The light fixture of claim 1 wherein the slidable mating of said axially-running grooves with said axially-running projections and the slidable engagement of said first and second lower edges with said first and second recesses allows the length of the light fixture to be adjusted in the field to adapt to varying dimensional requirements.

9. The light fixture of claim 1 further comprising a pivot plate for mounting one of said end plugs to a stair rail, said pivot plate including a front surface having a plurality of mounting holes, a circular opening for passing an electrical cable, and first and second tabs projecting therefrom for receiving a pivot pin.

10. The light fixture of claim 9 wherein said pivot plate further comprises an inner adapter plate positioned behind said front surface to strengthen the structure.

11. The light fixture of claim 10 wherein said pivot plate and said adapter plate are molded as a single unitary part.

12. The light fixture of claim 1 wherein each said carrier member comprises first and second LEDs.

13. A light fixture comprising:

a plurality of LED carrier members, each comprising an LED;

an elongated central housing having a plurality of axially-running projections on an inside surface thereof, said inside surface terminating in first and second lower ends;

first and second end plugs for insertion into the opposite ends of said housing, each end plug having an outer surface including a plurality of axially-running grooves each positioned to slidably receive a respective one of said axially-running projections, said outer surface having first and second lower ends, the first and second lower ends of said housing and first and second lower ends of said plugs being shaped to respectively slidably mate with one another; and an elongated extrusion positioned within a portion of the interior of said housing, said extrusion being shaped and dimensioned such that said extrusion snap-fits into and resiliently engages said housing, said extrusion further mounting each of said plurality of LED carrier members.

14. The light fixture of claim 13 wherein said elongated extrusion further comprises:

a central depending projection having an end; and first and second depending projections positioned on either side of said central depending projection, each of said first and second depending projections having an end shaped to retain an edge of one of said LED carrier members.

15. The light fixture of claim 14 wherein each of said LED carrier members comprises an LED mounting surface and a channel.

16. The light fixture of claim 13 wherein said extrusion has respective outer side surfaces which are flexible and of such stiffness that said extrusion snap fits into the housing.

17. The light fixture of claim 13 wherein each said carrier member comprises first and second LED's.

18. A light fixture comprising:

a plurality of LED carrier members, each comprising an LED;

an elongated central housing having a plurality of axially-running projections on an inside surface thereof, said inside surface terminating in first and second lower ends;

first and second end plugs for insertion into the opposite ends of said housing, each end plug having an outer surface including a plurality of axially-running grooves each positioned to slidably receive a respective one of said axially-running projections, said outer surface having first and second lower ends, the first and second lower ends of said housing and first and second lower ends of said plugs being shaped to respectively slidably mate with one another;

an elongated extrusion positioned within a portion of the interior of said housing, said extrusion being shaped and dimensioned such that said extrusion snap-fits into said housing, said extrusion further mounting each of said plurality of LED carrier members; and said extrusion further including a plurality of interior projections disposed to position and retain each of said plurality of LED carrier members.

19. The light fixture of claim 18 wherein the slidable mating of said axially-running grooves with said axially-running projections enables adjusting the length of the light fixture such that the light fixture has a selectable length, said selectable length enabling said light fixture to adapt to varying dimensional requirements.

20. The light fixture of claim 19 wherein said pivot plate further comprises an inner adapter plate positioned behind said front surface to strengthen the structure.

21. The light fixture of claim 18 further comprising a pivot plate for mounting one of said end plugs to a stair rail, said pivot plate including a front surface having a plurality of mounting holes, a circular opening for passing an electrical cable, and first and second tabs projecting therefrom for receiving a pivot pin.

22. The light fixture of claim 21 wherein said pivot plate further comprises an inner adapter plate positioned behind said front surface to strengthen the structure.

23. Light fixture of claim 18 further comprising a pivot plate for mounting one of said end plugs to a stair rail, said pivot plate including a front surface having a plurality of mounting holes, a circular opening for passing an electrical cable, and first and second tabs projecting therefrom for receiving a pivot pin.

24. The light fixture of claim 18 wherein each said carrier member comprises first and second LED's.

25. A light fixture comprising:

a plurality of LED carrier members, each comprising an LED;

an elongated central housing having a plurality of axially-running projections on an inside surface thereof, said inside surface terminating in first and second lower edges, each first and second lower edge having a respective inwardly projecting lip;

first and second end plugs for insertion into the opposite ends of said housing, each end plug having an outer surface including a plurality of axially-running grooves each positioned to slidably receive and mate with a respective one of said axially-running projections, said outer surface further having first and second recesses formed respectively along first and second lower edges thereof, said first and second recesses each being sized and dimensioned to slidably receive and mate with a respective one of said inwardly projecting lips;

an elongated extrusion positioned within a portion of the interior of said housing, said extrusion including a plurality of outer surfaces shaped and dimensioned such that said extrusion snap-fits into said housing, said extrusion further including a plurality of interior projections disposed to position and retain each of said plurality of LED carrier members; and wherein the slidable mating of said axially-running grooves with said axially-running projections enables adjusting the length of the light fixture such that the light fixture has a selectable length, said selectable length enabling said light fixture to adapt to varying dimensional requirements.

26. The light fixture of claim 25 wherein each said carrier member comprises first and second LED's.

27. A light fixture comprising:

an elongated central housing having a plurality of axially-running projections on an inside surface thereof, said inside surface terminating in first and second lower ends;

a plurality of LED's positioned within said central housing;

first and second end plugs each having respective first ends shaped for insertion into respective opposite ends of said housing, each end plug having an outer surface including a plurality of axially-running grooves each positioned to slidably receive a respective one of said axially-running projections, said outer surface having first and second lower ends, the first and second lower ends of said housing and first and second lower ends of said end plugs being shaped to respectively slidably mate with one another;

wherein each end plug further has an end portion opposite its respective first end shaped and dimensioned to enable attachment to cooperating apparatus;

wherein the slidable mating of said axially-running grooves with said axially-running projections enables adjusting the length of the light fixture such that the light fixture has a selectable length, said selectable length enabling said light fixture to adapt to varying dimensional requirements; and a pivot plate for mounting one of said end plugs to a stair rail, said pivot plate including a front surface having a plurality of mounting holes, a circular opening for passing an electrical cable, and first and second tabs projecting therefrom for receiving a pivot pin.

28. The light fixture of claim 27 wherein said pivot plate further comprises an inner adapter plate positioned behind said front surface to strengthen the structure.

29. The light fixture of claim 27 wherein the end portion of each end plug is shaped and dimensioned to permit pivotal attachment to a cooperating component.

30. A light fixture comprising:

an elongated central housing having an inside surface, said inside surface terminating in first and second lower ends;

a plurality of LED's positioned within said central housing;

first and second end plugs each having respective first ends shaped for insertion into respective opposite ends of said housing, each end plug having an outer surface and wherein the outer surface of each end plug and the inside surface of the central housing comprise a mating groove structure shaped and dimensioned such that each end plug slidably mates with the central housing, wherein the slidable mating of said central housing with said first and second end plugs enables adjusting the length of the light fixture such that the light fixture has a selectable length, said selectable length enabling the light fixture to adapt to varying dimensional requirements, each end plug further having an end portion opposite its respective first end shaped and dimensioned to enable attachment to cooperating apparatus; and a pivot plate for mounting one of said end plugs to a stair rail, said pivot plate including a front surface having a plurality of mounting holes, a circular opening for passing an electrical cable, and first and second tabs projecting therefrom for receiving a pivot pin.

31. The light fixture of claim 30 wherein the end portion of each end plug is shaped and dimensioned to permit pivotal attachment to said pivot plate.

32. A light fixture comprising:

an elongated central housing having a plurality of axially-running projections on an inside surface thereof, said inside surface terminating in first and second lower ends;

a first LED carrier member disposed at a first angle with respect to the vertical and positioned within said central housing on a right side thereof and comprising a first LED mounted thereon;

a second LED carrier member disposed at a second angle to the vertical within said central housing on a left side thereof and comprising a second LED mounted thereon;

the positions of the first and second LED carrier members and first and second angles being such that LED light is directed from said first carrier member downwardly toward the left and such that LED light is directed from said second carrier member downwardly and toward the right;

said first and second LED carrier members being held in position within said central housing by an intermediate support component removably fixed in position in the interior of said central housing;

first and second end plugs each having respective first ends shaped for insertion into respective opposite ends of said housing, each end plug having an outer surface including a plurality of axially-running grooves each positioned to slidably receive a respective one of said axially-running projections, said outer surface having first and second lower ends, the first and second lower ends of said housing and first and second lower ends of said end plugs being shaped to respectively slidably mate with one another;

wherein each end plug further has an end portion opposite its respective first end shaped and dimensioned to enable attachment to cooperating apparatus; and wherein the slidable mating of said axially-running grooves with said axially-running projections enables adjusting the length of the light fixture such that the light fixture has a selectable length, said selectable length enabling said light fixture to adapt to varying dimensional requirements.

33. A light fixture comprising:

an elongated central housing having an inside surface, said inside surface terminating in first and second lower ends;

a first LED carrier member disposed at a first angle with respect to the vertical and positioned within said central housing on a right side thereof and comprising a first LED mounted thereon;

a second LED carrier member disposed at a second angle to the vertical within said central housing on a left side thereof and comprising a second LED mounted thereon;

the positions of the first and second LED carrier members and first and second angles being such that LED light is directed from said first carrier member downwardly toward the left and such that LED light is directed from said second carrier member downwardly and toward the right;

said first and second LED carrier members being held in position within said central housing by an intermediate support component removably fixed in position in the interior of said central housing;

first and second end plugs each having respective first ends shaped for insertion into respective opposite ends of said housing, each end plug having an outer surface and wherein the outer surface of each end plug and the inside surface of the central housing comprise a mating groove structure shaped and dimensioned such that each end plug slidably mates with the central housing, and wherein the slidable mating of said central housing with said first and second end plugs enables adjusting the length of the light fixture such that the light fixture has a selectable length, said selectable length enabling the light fixture to adapt to varying dimensional requirements, each end plug further having an end portion opposite its respective first end shaped and dimensioned to enable attachment to cooperating apparatus.

* * * * *